United States Patent [19]

Bold

[11] 4,254,887

[45] Mar. 10, 1981

[54] STORAGE TANK

[75] Inventor: Stephen E. Bold, Ivor Heath, England

[73] Assignee: The British Petroleum Company Limited, London, England

[21] Appl. No.: 18,290

[22] Filed: Mar. 6, 1979

[30] Foreign Application Priority Data

Mar. 15, 1978 [GB] United Kingdom ..... 10201/78

[51] Int. Cl.[3] ..... B65D 25/18; B65D 90/01

[52] U.S. Cl. ..... 220/85 B; 220/216; 220/225

[58] Field of Search ..... 220/85 B, 216, 217, 220/225, 226, 403, 404

[56] References Cited

U.S. PATENT DOCUMENTS

| | | | |
|---|---|---|---|
| 3,617,034 | 11/1971 | Skinner . | |
| 3,752,355 | 8/1973 | Weissenbach . | |
| 3,779,419 | 12/1973 | Heitz | 220/85 B |
| 3,931,907 | 1/1976 | Henle | 220/85 B |
| 4,079,856 | 3/1978 | Drake | 220/225 |

FOREIGN PATENT DOCUMENTS

| | | | |
|---|---|---|---|
| 1059954 | 2/1967 | United Kingdom | 220/85 B |

*Primary Examiner*—George E. Lowrance

[57] ABSTRACT

Liquid storage tank containing a collapsible bag of flexible impervious sheet material supported by a collar within the tank which floats on the stored liquid and moves with the liquid thereby dividing the interior of the shell into an air and a liquid space. The bag has an external skirt of a similar flexible sheet material attached to the supporting collar which lies between the bag and adjacent tank side walls to reduce abrasion and catching of the bag and tank walls particularly during tank emptying and filling procedures.

16 Claims, 4 Drawing Figures

STORAGE TANK

The present invention relates to seals for storage tanks, especially tanks for the storage of oils and volatile petroleum products.

In conventional storage tanks for oil there is a significant loss of the product stored to the atmosphere during the filling of such tanks. Volatile liquids are also lost generally due to "breathing" caused, e.g. by daily temperature variations.

The high cost of petroleum products has prompted a reappraisal of the cost effectiveness of methods of reducing vapour losses of these products. The use of floating decks is a well known attempt to solve this problem and another technique is the use of a floating roof system comprising a collapsible bag of impermeable material which floats on the stored liquid and moves with the liquid thus giving a reduced vapour space above the liquid. This latter method is more simple, avoids the use of a sliding seal and is less expensive in installation costs than the use of the floatng decks.

However, in practice, the collapsible bag technique has certain disadvantages, one of the most significant being the tendency of the collapsible bag to stick to the storage tank walls. This sticking prevents the collapsible bag from moving up and down in the tank following the liquid level and applies severe stretching forces to the bag when there is a substantial contact area between the bag and the walls of the tank. Our UK patent application No. 27847/75 is directed towards this problem.

The present invention is directed towards a further improvement of the performance of collapsible bag type vapour barriers. It has been found that although the use of a tapered bag construction reduces the tendency of the bags to stick to the tank walls, the bag is still subject to wear particularly by abrasion and catching on projections or defects of the walls. The coating of the internal walls of the tanks is relatively expensive and often impractical for various reasons such as the necessity for descaling and cleaning. By use of a surrounding skirt, these problems are reduced and also an improvement in storage efficiency may be obtained.

Thus, according to the invention there is provided a liquid storage tank comprising a rigid shell having substantially vertical side walls, a collapsible bag of impervious flexible sheet material positioned within the tank and dividing the interior of the rigid shell into an air space and a liquid space, means for supporting the bag in the tank and for tending to space apart the bag from the side wall of the tank, there being a skirt external to the bag which interposes between the bag and the adjacent side wall of the tank.

Preferably the skirt is formed of the same material as the bag. The skirt is preferably attached to the bag by conventional adhesive stitching or welding techniques. Preferably the skirt is attached to the upper part of the bag and extends downwards thereby spacing apart the bag from the tank walls. In a preferred embodiment, the skirt is attached to the upper part of the bag, is passed over the top of the inflatable collar and between the collar and tank walls, then being allowed to hang freely from the collar. The thickness of the skirt has its upper limits determined by rigidity and weight considerations and its lower limits determined by commercial availability and preferably the skirt thickness is from 12 to 50 microns. Alternatively the skirt may be made from abrasion resistant plastics such as a polyurethane or other types of protective material. In applications where inflammable liquids are being stored e.g. gasoline tank, it is desirable that anti-static materials are used or anti-static precautions are taken.

Also it is preferable that the skirt is weighted in some way e.g. by placing a weight around the lower edge of the skirt to prevent any possibility of the skirt riding up the sides of the tank particularly during filling and emptying procedures or by use of a higher density base portion. Also preferably the skirt near its upper end is perforated to avoid vapour lock occuring particularly during tank filling.

Preferably the means for supporting the bag in the tank comprises a periphal collar, most preferably an inflatable collar, attached to the bag.

In one embodiment of the invention, the collapsible bag in its fully extended form comprises a cylinder or truncated cone, having circumferential bracing rings, the diameter of the rings being less than the tank diameter. The rings are preferably made from steel. As the tank fills with liquid, the rings and bag collapse together like a concertina and open out again as the tank empties.

In a second embodiment of the invention, the collapsible bag in its fully extended form, comprises a truncated cone which tapers away from the open end of the bag and is sufficiently rigid to maintain the walls of the bag apart from the side walls of the tank. Preferably the degree of taper of the cone is from 1° to 10° from the vertical.

Preferably the fixed peripheral collar is placed above the upper liquid level in the tank and most preferably forms an integral part of the collapsible bag.

The collapsible bag may terminate at the peripheral collar, the bag being then in effect a simple membrane and in which case, the mouth may be pinched between the peripheral collar and the tank walls. Preferably, however, the bag continues above the collar with the mouth being fixed to a vent port of the tank in the roof of the tank and thus may give a further primary seal against vapour egress through the vent port. (This is particularly important when storing volatile products).

The fixed peripheral collar preferably comprises an inflatable tube which is inflated against the upper side wall of the tank to form a seal and support and to minimise vertical movement of the collar. To assist in achieving the latter requirement, the collar may be inflated into a peripheral recess or the like in the tank walls. Flanges and indentations on the tank wall may also be used to assist in holding the collar in place. The tube desirably, as in the case of the collapsible bag, is made of a vapour impermeable material but is preferably of stronger construction than the collapsible bag. Thus, it may be made of a synthetic or natural rubber, e.g. a butadiene-acrylonitrile co-polymer and have a wall thickness of preferably from 0.5 to 15 mms.

Preferably the inflatable tube has a connection to a suitable port in the tank roof so as to allow inflation and maintenance of inflation from an external pressurising source. A particular advantage arising from the use of an inflatable tube is that the tube in collapsed form and the bag connected to it can be inserted through a relatively small hole in the tank roof and then is inflated inot position. Thus, the present invention is particularly suitable for adding a seal to existing tanks and even with new tanks there is no necessity to position the tube and bag prior to adding the tank roof. The bag and/or tube may have one or more lines of, for example, a nylon rope connecting it to the tank roof to vie extra support. In such lines pass through a port, the bag and tube can be withdrawn and replace easily in the event of either the bag or tube being damaged.

The dimensions of the peripheral collar are preferably chosen so that the collapsible bag (at the collar) is spaced from the tank walls by a distance of 1 to 10% of the depth of the tank i.e. the tank depth from the collar to the tank base.

For storage of petroleum products it is desirable that the permeation rate of such products through the collapsible bag is very small for economic and conseration reasons. Thus, preferably for storage of petroleum products, the bag is fabricated from polyvinyl fluoride (Tedlar), Polyvinylidene chloride (Saran), or polyester (Mylar) films. Other materials are described in our UK patent application number 16213/77 and European patent application No. 79300065.4.

For the above mentioned plastics materials, the thickness of the collapsible bag typically varies from 10 to 70 micrometers. Preferably the collapsible bag is fabricated in sections which are heat sealed together to give a gas tight seal.

The storage tanks are preferably cylindrical and typically have sizes of the order 30 to 80 feet diameter and up to 30 feet in height.

Preferably anti-static compounds are incorporated into the collapsible bags to avoid build up of static charges which would be hazardous if, for example, the storage tanks are used for containment of petroleum products.

The collapsible bag preferably incorporates means for dipping of the tank. Preferably the collapsible bag has a dipstick passing down into the tank and preferably close to the tank wall so that the liquid level in the tank can be determined from time to time.

The invention will now be described by way of example only with reference to the drawings accompanying the Specification.

Figure 1:
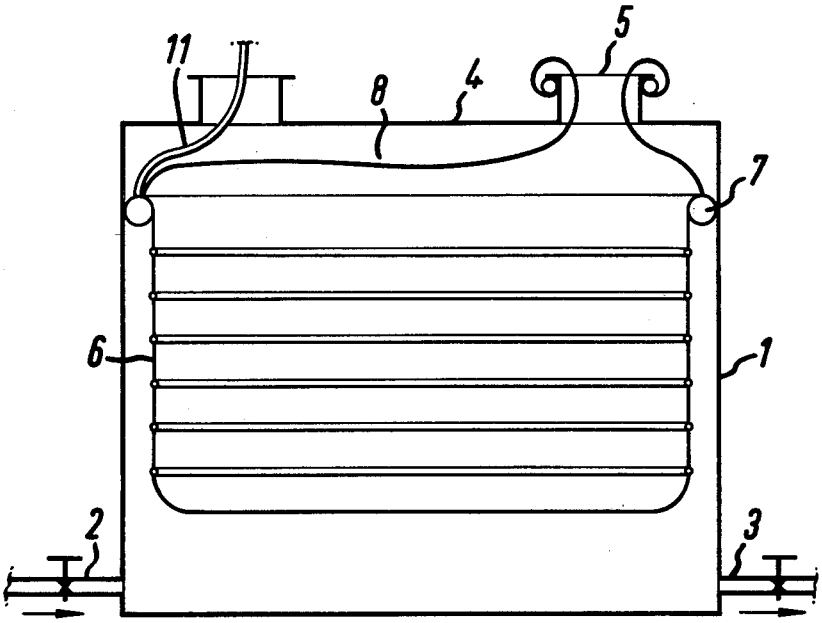
FIG. 1 shows a diagrammatic cross-section of a storage tank having a floating seal incorporating circumferential bracing.

The storage tank 1 has an inlet 2 and an outlet 3 for filling and emptying with the stored liquid, usually a petroleum product. The tank 1 has a steel roof 4 having one or more vents 5 through which access to the tank interior may be gained for installation and support. The tanks usually incorporate a pressure-relief valve for release of excess air pressure.

The collapsible bag 6 is made of a suitable liquid-impervious material which is inert, resistant to tearing or puncture and flexible. The permeation rates of 100 octane motor spirit through some plastics materials are shwon in Table 1. The values obtained show that any materials as good as or better than Saran 19 may be used for tanks containing motor spirit.

TABLE 1

Permeation Rate (in g/m$^2$/24 hours) of 100 octane motor spirit through Polymer Films

| | FILM THICKNESS | TEMPERATURE (°C.) | | | |
|---|---|---|---|---|---|
| | | 0* | 20 | 30 | 40 |
| SARAN 19 | 50 | — | 0.8–1.8 | 1.2–2.2 | 2.4 |
| SARAN WRAP | 25 | — | 0.9–1.2 | — | — |
| TEDLAR 100 SG | 20 | <.005 | 0.02 | 0.25 | 0.39 |
| TEDLAR 200 SG | 40 | <.005 | 0.01 | 0.03 | 0.225 |
| TEDLAR 100 EM | 25 | <.005 | 0.01–0.02 | — | — |
| MYLAR | 10 | v. small | <0.01 | 0.8–.12 | 0.15 |
| HDPE | 40 | — | 470 | — | — |
| LDPE | 40 | — | 1300 | — | — |

*Estimated values
(HDPE, LDPE-high density, low density polyethylene)
(Film thickness is expressed in micrometers)

The bag is inserted in the tank 1 and is of such a size that when the tank is empty, the bag 6 substantially fills the interior of the tank in the form shown in FIG. 1.

The bag 6 is held in position against the wall of tank 1 by means of a peripheral inflatable collar 7. A flexible connector tube 11 serves to inflate the collar 7 and also may be used to retrieve a defective collar or bag. The bag 6 may be permanently welded to the collar 7 or the edges of the bag 6 may be passed over the collar 7 which is then inflated so as to pinch the bag 6 against the walls of tank 1. The bag 6 passes over the top and inside of collar 7 otherwise it is found that the friction between the bag 6 and tank 1 is so great that sticking of the bag 6 occurs on the tank walls. The bag 6 is clamped at the access port forming a primary seal at 5.

As liquid is passed into tank 1 through inlet 2, the liquid presses against the underside of bag 6, thus collapsing the bag and expelling air from the tank interior 8 and through the vents 5. Because of the impermeable nature of bag 6, this expelled air will contain no or little vapour from the stored liquid. Filling continues as necessary or until, for example, a safety shut-off circuit interrupts the filling operation. Similarly, when the tank is emptied, the collapsible bag 6 moves downward with the liquid level and atmospheric air passes in through the vents 5 to replace the volume left by the liquid.

Figure 2:
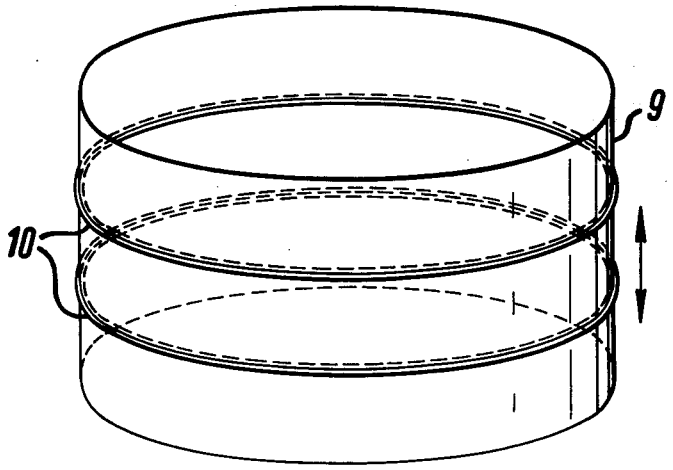
FIG. 2 shows a diagrammatic representation of the bracing of the seal.

FIG. 2 illustrates the structure of the collapsible bag 6 in more details. The bag is formed from panels of impermeable plastics material e.g. Tedlar, Saran, Mylar which are heat welded together, in the form of a closed cylinder 9. The bag is re-inforced with circumferential steel bands or rings or pneumatic rings 10 which cause the bag 6 to concertina as the liquid level in the tank moves up and down.

Figure 3:
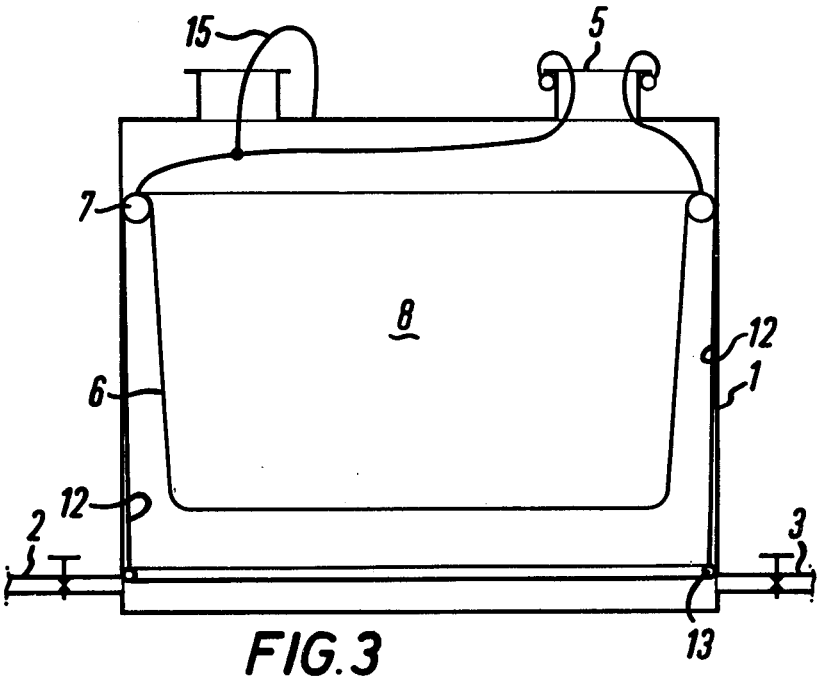
FIG. 3 shows a storage tank having a floating seal, the edges of which are tapered and having an integral skirt.

FIG. 3 shows an embodiment of the invention. In this case, the steel bracing rings 10 are not used. Instead the collapsible bag is made to have sides which taper away from the tank wall. This tapering of the bag reduces the tendency of the bag to stick against the tank walls due to wall/bag frictional forces being set up. The bag may be retrieved by line 15 which may also act as an extra support.

The collapsible bag 6 also has a substantially cylindrical skirt 12 (of the same materials as the bag) attached to the upper part of bag 6, passes over the top of inflatable collar 7 and between walls of tank 1 and collar 7 and then hangs extending to a position near the base of the tank 1. The skirt 12 is adhesively hot bonded around the periphery of the bag 6 before installation and when installed the skirt 12 joins the bag 6 at a point on the collar 7. The skirt 12 also has a weight 13 incorporated in its hem so as to maintain the skirt 12 substantially vertical and near to the tank wall. During emptying and filling of tank 1, the bag 6 is prevented from contacting the tank wall by the presence of the smoother and less abrasive surface of the skirt 12. Also the presence of the skirt of plastics material may enhance the thermal insulation of the tank and thereby reduce the tendency of water condensation occurring. The skirt is perforated at its upper end to prevent vapour lock occurring, excess vapour escaping past the collar 7 into the upper tank space.

Figure 4:
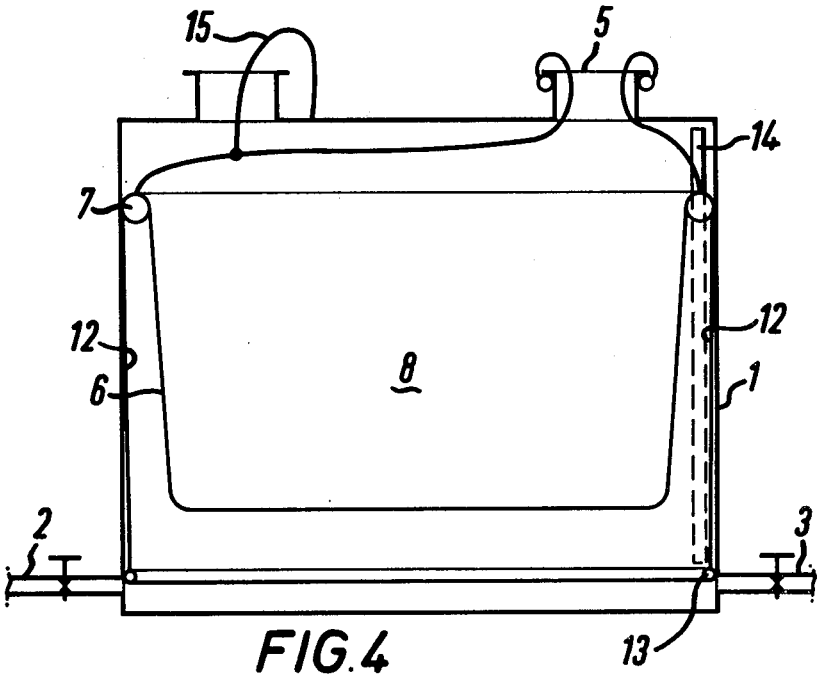
FIG. 4 shows a storage tank having a floating seal incorporating a dipping modification and having an integral skirt.

FIG. 4 shows a further modification to the tank seal which enables dipping e.g. for test purposes to be carried out in the same manner as used on conventional floating roofs.

The modification consists of a perforated pipe 14 close to the inner wall of the tank and extending from near the roof to the inner wall of the tank to the base of the tank 1. The pipe 14 carries a dipstick for determining the level of liquid in the tank 1 from time to time. The collar 7 passes around this pipe 14, the skirt 16 in this case being attached to the collar 7 and lying adjacent to the inner wall of the tank 1.

I claim:

1. A liquid storage tank comprising a rigid shell having substantially vertical walls, a collapsible bag of impervious flexible sheet material positioned within the tank and dividing the interior or the rigid shell into an air space and a liquid space, peripherally disposed supporting means interiorly positioned around said vertical walls of the tank near the upper peripheral portion of the bag for engaging and supporting the bag inside the tank and for maintaining the bag in spaced relation from the vertical walls of the tank, and a skirt attached to the external wall of the bag near the upper peripheral portion of the bag at the jointure point of the supporting means and the bag and positioned external to the bag and the supporting means so that the said skirt is interposed between the bag and the supporting means and the adjacent vertical walls of the tank, said skirt extending to a position near the base of the tank so that said skirt prevents said bag from contacting said adjacent vertical walls of the tank.

2. A tank according to claim 1 in which the supporting means for supporting the bag in the tank comprises peripheral collar attached to the bag.

3. A tank according to claim 2 in which the skirt passes between the collar and adjacent side wall of the tank.

4. A tank according to claim 2 in which the peripheral collar is inflatable.

5. A tank according to claim 4 in which the inflatable collar is inflated into a peripheral recess in the side walls of the tank to assist in holding the collar in place.

6. A tank according to claim 4 in which the inflatable collar is supported by flanges disposed in the side walls of the tank to assist in holding the collar in place.

7. A tank according to claim 4 in which the inflatable collar is attached to an external pressurising source.

8. A tank according to claim 1 in which the skirt is formed from the same material as the collapsible bag.

9. A tank according to claim 1 in which the skirt is formed from a polyurethane, polyvinyl floride, polyvinylidene chloride or a polyester.

10. A tank according to claim 1 in which the collapsible bag and skirt contain an anti-static compound.

11. A tank according to claim 1 in which the skirt is weighted.

12. A tank according to claim 1 in which the upper part of the skirt is perforated.

13. A tank according to claim 1 in which the skirt has a thickness of from 12 to 50 microns.

14. A tank according to claim 1 in which the collapsible bag in its fully extended form comprises a truncated cone which tapers away from the open end of the bag and having sufficient rigidity to maintain the walls of the bag apart from the side walls of the tank.

15. A tank according to claim 14 in which the degree of taper of the cone is 1° to 10° from the vertical.

16. A tank according to claim 1 in which the collapsible bag in its fully extended form comprises a cylinder having circumferential bracing rings, the diameter of the rings being less than the storage tank diameter.

* * * * *